US011412591B2

(12) United States Patent
Li

(10) Patent No.: US 11,412,591 B2
(45) Date of Patent: Aug. 9, 2022

(54) INDUCTIVE SERIES SWITCH CONTROL SYSTEM

(71) Applicant: Shenzhen Zixuan Optoelectronic Technology Co., Ltd, Shenzhen (CN)

(72) Inventor: Rui Li, Yicheng (CN)

( * ) Notice: Subject to any disclaimer, the term of this patent is extended or adjusted under 35 U.S.C. 154(b) by 0 days.

(21) Appl. No.: 17/353,842

(22) Filed: Jun. 22, 2021

(65) Prior Publication Data

US 2021/0337641 A1 Oct. 28, 2021

(30) Foreign Application Priority Data

May 17, 2021 (CN) ..... 202121046650.1

(51) Int. Cl.
*H05B 45/00* (2022.01)
*H05B 45/30* (2020.01)

(52) U.S. Cl.
CPC ..... *H05B 45/30* (2020.01)

(58) Field of Classification Search
CPC ..... H05B 45/00; H05B 45/30; H05B 45/37; H05B 45/3725; H05B 47/10; H05B 47/185
See application file for complete search history.

(56) References Cited

U.S. PATENT DOCUMENTS

| | | | | |
|---|---|---|---|---|
| 8,352,342 | B1 * | 1/2013 | Bent, II | G06Q 40/06 705/35 |
| 10,143,061 | B2 * | 11/2018 | Zou | H05B 45/3725 |
| 2007/0216392 | A1 | 9/2007 | Stevens et al. | |
| 2009/0243601 | A1 | 10/2009 | Feldtkeller | |
| 2010/0123451 | A1 | 5/2010 | Freer | |
| 2010/0181833 | A1 * | 7/2010 | Wu | H05B 45/3725 307/36 |
| 2011/0062888 | A1 * | 3/2011 | Bondy | H05B 45/3725 315/294 |
| 2019/0104583 | A1 * | 4/2019 | Konishi | H05B 45/375 |
| 2020/0077480 | A1 * | 3/2020 | Treciokas | H05B 47/18 |
| 2020/0367345 | A1 * | 11/2020 | Cao | H05B 45/44 |

* cited by examiner

*Primary Examiner* — Thai Pham

(57) ABSTRACT

The present disclosure discloses an inductive series switch control system. The control system includes several control modules that are connected in series, a first output inductive switch, and a second output inductive switch. Each control module is independently connected with an output interface, and each output interface is connected to a light-emitting diode (LED)lamp of a stair lamp; every two adjacent control modules are connected through three lines that are respectively a positive circuit, a negative circuit, and a signal circuit; the first output inductive switch is electrically connected to the first control module in the serially connected control modules; the second output inductive switch is electrically connected to the last control module in the serially connected control modules; and the positive circuit and the negative circuit between any two control modules are connected to a power input end.

2 Claims, 3 Drawing Sheets

INDUCTIVE SERIES SWITCH CONTROL SYSTEM

TECHNICAL FIELD

The present disclosure relates to a light-emitting diode (LED) lamp control system, and specifically relates to an inductive series switch control system.

BACKGROUND

As shown in FIG. 1, a schematic circuit diagram of a stair lamp control system in the existing technology, including a stair lamp controller 14, an inductive head A 13 electrically connected to the stair lamp controller 14, and an inductive head B 14 electrically connected to the stair lamp controller 14. The power input end of the stair lamp controller 14 is connected to a transformer 16, and the input end of the transformer 16 is connected to a neutral line 11 and a live line 12 of a mains supply. The transformer 16 converts alternating current to direct current of 12V and inputs the direct current to the stair lamp controller 14.

The traditional stair lamp control system uses a main controller and a sub-control port, or uses a signal encoding method to control operation of a stair lamp. The installation of the traditional stair lamp is complicated, and the operation is cumbersome and highly difficult, so that installation personnel need to have professional knowledge to complete the installation.

SUMMARY

For the deficiencies in the existing technology, the technical problem to be solved in the present disclosure is to provide an inductive series switch control system.

In order to solve the above-mentioned technical problem, the present disclosure is implemented by the following solution: an inductive series switch control system of the present disclosure. The control system includes:

several control modules that are connected in series, wherein each control module is independently connected with an output interface, and each output interface is connected to a light-emitting diode (LED) lamp of a stair lamp; every two adjacent control modules are connected through three lines that are respectively a positive circuit, a negative circuit and a signal circuit;

a first output inductive switch that is electrically connected to the first control module in the serially connected control modules; and a second output inductive switch that is electrically connected to the last control module in the serially connected control modules.

The anode circuit and the cathode circuit between any two control modules are connected to a power input end;

each control module includes an LED control circuit; the LED control circuit includes a singlechip microcomputer U2; the singlechip microcomputer U2 has 8 pins. The 8 pins are respectively connected to the following circuits.

The VCC-1 pin is connected to a resistor R6, a resistor R7, a capacitor C2, a capacitor C3, and the VOUT-1 pin of a voltage stabilizer chip; the capacitor C2 and the capacitor C3 are connected in parallel and then grounded and are connected to the GND-2 pin of the voltage stabilizer chip; the VIN-3 pin of the voltage stabilizer chip is connected with a resistor R1 and a capacitor C1; the other end of the resistor R1 is connected to a cathode of a diode D1; an anode end of the diode D1 is connected to a power VCC end; the capacitor C1 is connected to the GND-2 pin of the voltage stabilizer chip;

the IOB4-3 pin and the IOB2-5 pin are connected with each other; the IOB4-3 pin is also connected with a resistor R2; the other end of the resistor R2 is connected with a resistor R5 and the gate of a metal oxide semiconductor (MOS) transistor M1; the resistor R5 is connected between the source and the gate of the MOS transistor M1; the source of the MOS transistor M1 is grounded; the drain of the MOS transistor M1 is connected to the 2-pin of an LED socket; the 1-pin of the LED socket is connected to the power VCC end;

the IOB1-6 pin is connected with the other end of the resistor R7, a resistor R4, and a cathode of a voltage stabilizer diode D3; the other end of the resistor R4 is connected to the 2-pin of an OUT socket; the 1-pin of the OUT socket is grounded; the pin 3 of the OUT socket is connected to the power VCC end;

the IOB0-7 pin is connected with the other end of the resistor R6, a resistor R3, and a cathode of a voltage stabilizer diode D2; the other end of the resistor R3 is connected to the 2-pin of an IN socket; the 1-pin of the IN socket is grounded; the pin 3 of the IN socket is connected to the power VCC end;

the GND-8 pin is grounded and is connected to an anode of the voltage stabilizer diode D3 and an anode of the voltage stabilizer diode D2.

Further, the MOS transistor M1 is an N-channel MOS transistor.

Compared with the existing technology, the present disclosure has the beneficial effects that the present disclosure uses a double-channel control module and cancels the previous main controller, so that the present disclosure cannot be limited by controller ports; and moreover, the installation is simple, and can be completed by wiring for energization.

DESCRIPTION OF THE EMBODIMENTS

Figure 1:
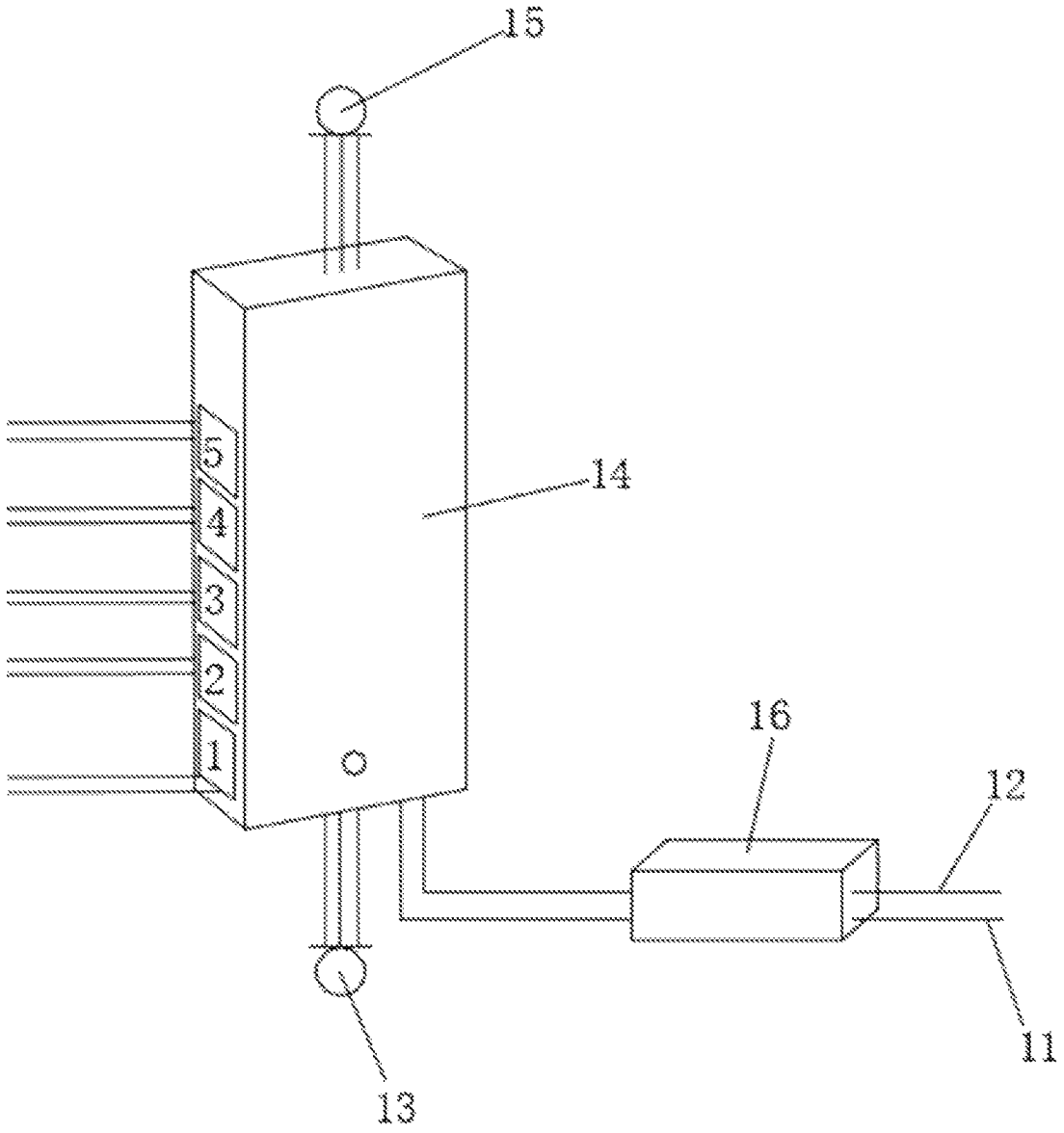
FIG. 1 (Prior Art)
FIG. 1 is a schematic circuit diagram of a control system in the existing technology.

The following will clearly and completely describe the technical solutions in the embodiments of the present disclosure in conjunction with the accompanying drawings in the embodiments of the present disclosure, so that the advantages and features of the present disclosure can be more easily understood by those skilled in the art to make a clearer definition to the protection scope of the present disclosure. Obviously, the embodiments described in the present disclosure are a part of the embodiments of the present disclosure only, not all the embodiments. Based on the embodiments in the present disclosure, all other embodiments obtained by those of ordinary skill in the art without creative work shall fall within the protection scope of the present disclosure.

In the description of the present disclosure, it should be noted that orientations or positional relationships indicated by the terms "center", "upper", "lower", "left", "right", "vertical", "horizontal", "inside", "outside" and the like are orientations or positional relationships as shown in the drawings, and are only for the purpose of facilitating and simplifying the description of the present utility model instead of indicating or implying that devices or elements indicated must have particular orientations, and be constructed and operated in the particular orientations, so that these terms are not construed as limiting the present utility model. In addition, the terms "first", "second" and "third" are only for the purpose of description, and may not be understood as indicating or implying the relative importance.

In the description of the present disclosure, it should be noted that unless otherwise explicitly defined and defined, the terms "installed", "coupled" and "connected" shall be understood broadly, and may be, for example, fixedly connected, detachably connected, integrally connected, mechanically connected, electrically connected, directly connected, indirectly connected through an intermediate medium, internally communication between two elements, wirelessly connected, or wiredly connected. Those of ordinary skill in the art can understand the specific meanings of the above terms in the present disclosure according to specific situations.

In addition, technical features involved in different implementation modes of the present disclosure described below may be mutually combined as long as they do not constitute conflicts.

Embodiment 1: the specific structures of the present disclosure are as follows.

Figure 2:
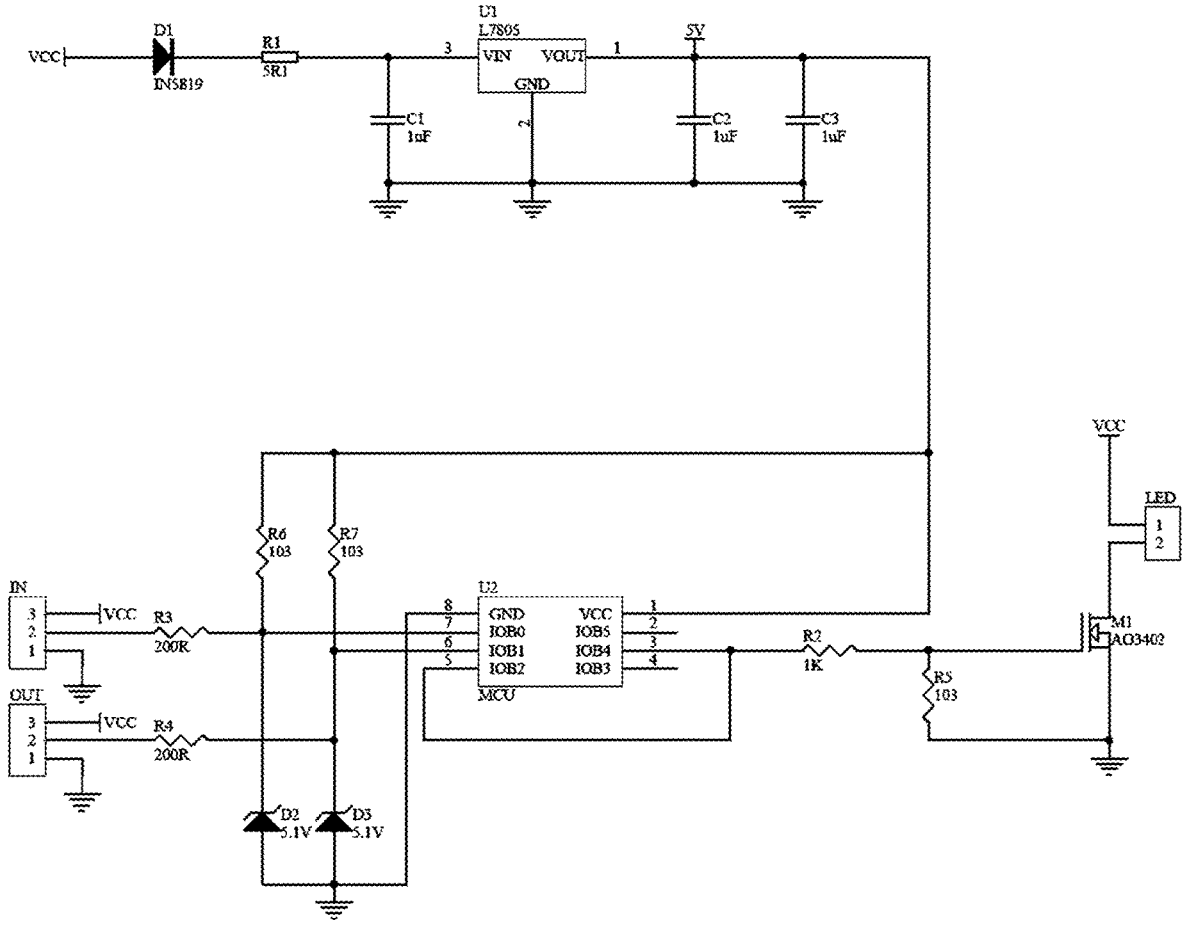
FIG. 2 is a schematic circuit diagram of a control system of the present disclosure.
Figure 3:
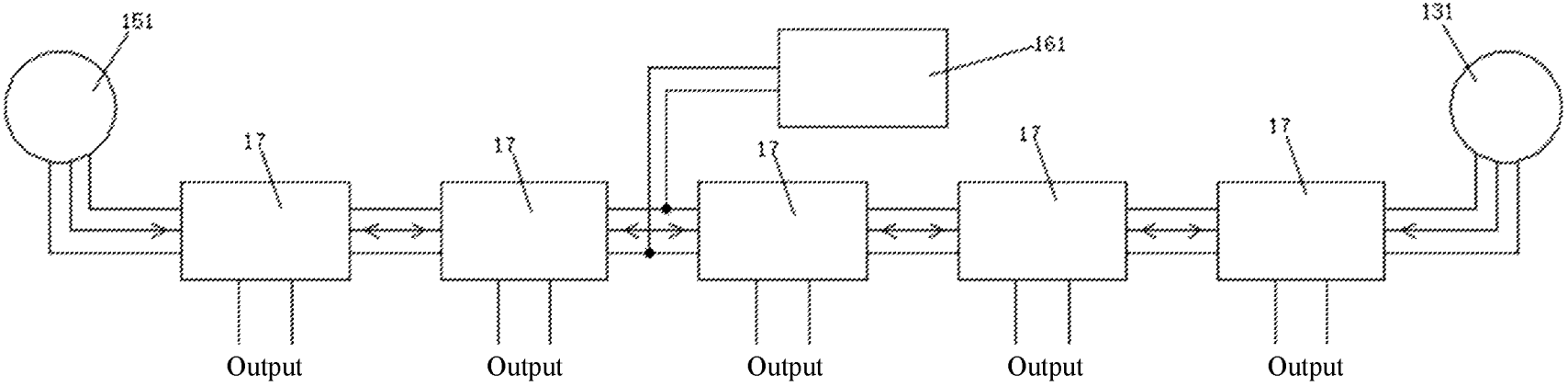
FIG. 3 is a schematic wiring diagram of a control system of the present disclosure.

Referring to FIG. 2 to FIG. 3, an inductive series switch control system of the present disclosure is provided. The control system includes:

several control modules 17 that are connected in series, wherein each control module 17 is independently connected with an output interface, and each output interface is connected to a light-emitting diode (LED) lamp of a stair lamp; every two adjacent control modules 17 are connected through three lines that are respectively an anode circuit, a negative circuit, and a signal circuit;

a first output inductive switch 151 that is electrically connected to the first control module in the serially connected control modules 17; and a second output inductive switch 131 that is electrically connected to the last control module in the serially connected control modules 17.

The anode circuit and the cathode circuit between any two control modules 17 are connected to a power input end 161;

each control module 17 includes an LED control circuit; the LED control circuit includes a singlechip microcomputer U2. The singlechip microcomputer U2 of the present disclosure is a programmable singlechip microcomputer.

The singlechip microcomputer U2 has 8 pins. The 8 pins are respectively connected to the following circuits.

The VCC-1 pin is connected to a resistor R6, a resistor R7, a capacitor C2, a capacitor C3, and the VOUT-1 pin of a voltage stabilizer chip; the capacitor C2 and the capacitor C3 are connected in parallel and then grounded and are connected to the GND-2 pin of the voltage stabilizer chip; the VIN-3 pin of the voltage stabilizer chip is connected with a resistor R1 and a capacitor C1; the other end of the resistor R1 is connected to a cathode of a diode D1; an anode end of the diode D1 is connected to a power VCC end; the capacitor C1 is connected to the GND-2 pin of the voltage stabilizer chip;

the IOB4-3 pin and the IOB2-5 pin are connected with each other; the IOB4-3 pin is also connected with a resistor R2; the other end of the resistor R2 is connected with a resistor R5 and the gate of a metal oxide semiconductor (MOS) transistor M1; the resistor R5 is connected between the source and the gate of the MOS transistor M1; the source of the MOS transistor M1 is grounded; the drain of the MOS transistor M1 is connected to the 2-pin of an LED socket; the 1-pin of the LED socket is connected to the power VCC end; the LED socket is connected to the LED lamp;

the IOB1-6 pin is connected with the other end of the resistor R7, a resistor R4, and a cathode of a voltage stabilizer diode D3; the other end of the resistor R4 is connected to the 2-pin of an OUT socket; the 1-pin of the OUT socket is grounded; the pin 3 of the OUT socket is connected to the power VCC end; the OUT socket is the output end in FIG. 3;

the IOB0-7 pin is connected with the other end of the resistor R6, a resistor R3, and a cathode of a voltage stabilizer diode D2; the other end of the resistor R3 is connected to the 2-pin of an IN socket; the 1-pin of the IN socket is grounded; the pin 3 of the IN socket is connected to the power VCC end; the IN socket is an input end;

the GND-8 pin is grounded and is connected to an anode of the voltage stabilizer diode D3 and an anode of the voltage stabilizer diode D2.

In one preferred technical solution of the present embodiment, the MOS transistor M1 is an N-channel MOS transistor.

Embodiment 2

As shown in FIG. 2 to FIG. 3, all the control modules 17 are connected in series, and the various control modules are connected through three lines, one for an anode line, one for a cathode line, and one for a power line. The power line is used for signal transmission. Signal transmission between the various control modules is bidirectional.

The first control module is connected to the first output inductive switch 151. The first control module is also connected to the first output inductive switch 151 through three lines that are respectively an anode line, a cathode line and a power line. The power line is used for signal transmission. The first output inductive switch 151 unidirectionally outputs a signal to the first control module.

The last control module is connected to the second output inductive switch 131. The last control module is also connected to the second output inductive switch 131 through three lines that are respectively an anode line, a cathode line and a power line. The power line is used for signal transmission. The second output inductive switch 131 transmits a signal to the last control module in one direction.

Each control module is connected with an output circuit, and the output circuit is a power output. By means of wiring of FIG. 3, a wiring position of the power input end 161 is between any two control modules. Therefore, the present disclosure can switch any power supply to control the LED lamp. The present disclosure uses a double-channel control module and cancels the previous main controller, so that the present disclosure cannot be limited by controller ports; and moreover, the installation is simple, and can be completed by wiring for energization.

The above descriptions are only the preferred implementation modes of the present disclosure, and are not intended to limit the patent scope of the present disclosure. Any equivalent structure or equivalent process transformation made by using the content of the specification and drawings of the present disclosure and directly or indirectly applied to other related technical fields shall all be similarly included in the scope of patent protection of the present disclosure.

What is claimed is:

1. An inductive series switch control system, the control system comprising:

several control modules that are connected in series, wherein each control module is independently connected with an output interface, and each output interface is connected to a light-emitting diode (LED) lamp of a stair lamp; every two adjacent control modules are connected through three lines that are respectively an anode circuit, a negative circuit and a signal circuit;

a first output inductive switch that is electrically connected to the first control module in the serially connected control modules, and a second output inductive switch that is electrically connected to the last control module in the serially connected control modules, wherein the anode circuit and the cathode circuit between any two control modules are connected to a power input end;

each control module comprises an LED control circuit; the LED control circuit comprises a singlechip microcomputer; the singlechip microcomputer has eight pins; the eight pins are respectively connected to the following circuits:

a VCC-1 pin is connected to a sixth resistor, a seventh resistor, a second capacitor, a third capacitor, and a VOUT-1 pin of a voltage stabilizer chip; the second capacitor and the third capacitor are connected in parallel and then grounded and are connected to a GND-2 pin of the voltage stabilizer chip; a VIN-3 pin of the voltage stabilizer chip is connected with a first resistor and a first capacitor; the other end of the first resistor is connected to a cathode of a first diode; an anode end of the first diode is connected to a power VCC end; the first capacitor is connected to the GND-2 pin of the voltage stabilizer chip;

an IOB4-3 pin and an IOB2-5 pin are connected with each other; the IOB4-3 pin is also connected with a second resistor; the other end of the second resistor is connected with a fifth resistor and the gate of a metal oxide semiconductor (MOS) transistor; the fifth resistor is connected between the source and the gate of the MOS transistor; the source of the MOS transistor is grounded; the drain of the MOS transistor is connected to a 2-pin of an LED socket; an 1-pin of the LED socket is connected to the power VCC end;

an IOB1-6 pin is connected with the other end of the seventh resistor, a fourth resistor, and a cathode of a third voltage stabilizer diode; the other end of the fourth resistor is connected to a 2-pin of an OUT socket;

a 1-pin of the OUT socket is grounded; a 3-pin of the OUT socket is connected to the power VCC end;

an IOB0-7 pin is connected with the other end of the sixth resistor, a third resistor, and a cathode of a second voltage stabilizer diode; the other end of the third resistor is connected to a 2-pin of an IN socket, an 1-pin of the IN socket is grounded; a 3-pin of the IN socket is connected to the power VCC end;

a GND-8 pin is grounded and is connected to an anode of the third voltage stabilizer diode and an anode of the second voltage stabilizer diode.

2. The inductive series switch control system according to claim 1, wherein the MOS transistor is an N-channel MOS transistor.

* * * * *